US006142735A

United States Patent [19]

Müller

[11] Patent Number: 6,142,735

[45] Date of Patent: Nov. 7, 2000

[54] VARIABLE-PITCH PROPELLER, ESPECIALLY FOR SPORT CRAFT

[76] Inventor: Peter Müller, Isengrund 9, CH-8134 Adliswil, Switzerland

[21] Appl. No.: 09/183,958

[22] Filed: Nov. 2, 1998

[30] Foreign Application Priority Data

Dec. 5, 1997 [DE] Germany ..... 197 53 927

[51] Int. Cl.[7] ..... B63H 3/12

[52] U.S. Cl. ..... 416/164; 416/167; 416/168 R; 416/207; 416/220 A; 416/244 B

[58] Field of Search ..... 416/164, 168 R, 416/167, 204 R, 205, 207, 209, 219 A, 220 A, 244 B, 245 A

[56] References Cited

U.S. PATENT DOCUMENTS

| | | | |
|---|---|---|---|
| Re. 12,665 | 6/1907 | Perkins | 416/167 |
| 4,365,937 | 12/1982 | Hiebert | 416/157 R |
| 5,871,335 | 2/1999 | Bartlett | 416/244 R |

FOREIGN PATENT DOCUMENTS

| | | | |
|---|---|---|---|
| 0 231 503 | 8/1987 | European Pat. Off. . | |
| 453154 | 12/1913 | France | 416/220 A |
| 248 335 A1 | 8/1987 | Germany . | |
| 195 04 611 A1 | 8/1996 | Germany . | |

*Primary Examiner*—Edward K. Look
*Assistant Examiner*—Liam McDowell
*Attorney, Agent, or Firm*—Herbert Dubno

[57] ABSTRACT

A variable-pitch propeller, especially for a sport board, has angularly displaceable blade support plates which can be rotated about respective radial axes. The plates are provided with radially inwardly directed claws which engage in circumferential grooves of bases of the blades. The latter can have radial projections reaching beneath the claws. The resulting bayonet connection simplifies mounting and dismounting of the propeller blades even under water.

10 Claims, 3 Drawing Sheets

VARIABLE-PITCH PROPELLER, ESPECIALLY FOR SPORT CRAFT

FIELD OF THE INVENTION

My present invention relates to a propeller, especially for sport boats and other water craft having an engine. More particularly, the invention relates to a variable-pitch propeller in which the blades are rotatable about radial axes on a hub.

BACKGROUND OF THE INVENTION

Variable-pitch propellers for motor boats and the like, especially for sport craft, are known. Such variable-pitch propellers comprise, as has been described in EP O 231 503, a hub on which a plurality of mounting plates are provided for the respective blades. These mounting plates, for adjustment of the angular positions of the blades about their respective radial axes, are rotated by the blade adjustment mechanism within the hub. The bases of the blades are attached by screws to the respective plates.

This construction allows the blades to be removed from the hub and replaced, for example, by other blades. In many cases this replacement must be effected under water and where bolting of the base of the blade to the plate is necessary, the bolts can be lost, especially when the last bolt is being released, the blade itself may be lost as it is removed or mounted, and, as a general matter, the operation requires considerable dexterity and can be time-consuming. The problem of assembling the blades to the hub, of course, can apply to fixed-pitch propellers as well.

OBJECTS OF THE INVENTION

It is the principal object of the present invention, therefore, to simplify the mounting and dismounting of the blades of a propeller for a sport boat or other watercraft.

Another object of the invention is to provide a variable-pitch propeller with an improved mounting of the blades to the hub whereby drawbacks of the type described can be avoided.

Still another object of this invention is to provide a variable-pitch propeller in which the attachment and detachment of individual blades with respect to the adjustment or mounting plates for the blades on the hub can be made more reliable, especially to avoid loss of blades, loss of attachment elements, and to reduce the time required for underwater replacement of the blades.

SUMMARY OF THE INVENTION

These objects and others which will become apparent hereinafter are attained, in accordance with the invention, by providing each of the adjustment plates on the hub of the variable-pitch propeller so that it has two radial inwardly-directed claws. The base or foot of the blade is provided as a circumferential groove in which these claws can engage and the circumferential groove has a plurality of cutaway portions into which the claws can engage to pass into the groove. The portions between these cutaway openings of the part of the base defining the groove, can be radially-outward flanges or projections which can engage beneath the claws. The result is a bayonet connection between the adjustment plate and the base of the respective blade.

For the mounting of a new blade, the base of the new blade is fitted onto the plate so that the claws engage in the cutouts and the blade is then rotated through a fraction of a full revolution about its radial axis until the claws engage in the groove and the projections engage beneath the claws. Dismounting of the blade can be effected by an angular displacement of the blade relative to the plate in the opposite sense so that the claws and the projections are angularly offset from one another.

An especially reliable and stable connection of each blade to the respective plate is provided when the blade base has a planar underside and the adjustment plate a planar upper side. The claws can overhang the planar upper side with a spacing therefrom which corresponds to the thickness of the projections on the base. The base and the plate thus are braced flat against one another. To facilitate the mounting and dismounting of the blade the circumferential lengths of the claws and the projections may be substantially equal.

So that each blade and the respective plate can have a defined relative angular position, at least one of the claws is advantageously provided with a stop for a corresponding projection of the blade base. In this case, in mounting of the blade, the latter is rotated until its projection abuts the stop and the blade can then be locked in this angular position. To secure each blade to the plate in the predetermined angular position, a screw or bolt may be used which interconnects the blade base and the plate and is preferably offset from the radial axis of the blade.

By and large, however, the bayonet connection alone will suffice, i.e. the screw is not necessary, when the reaction force in rotation of the propeller, maintains the respective projection against the stop. In this case, the hydrodynamic flow forces suffice to prevent rotation of the blade angularly to release the bayonet connection.

A variable-pitch propeller according to the invention can thus comprise:

a hub provided with a pitch-adjustment mechanism;

a plurality of blade-support plates angularly spaced apart on the hub and rotatable about respective radial axes by the mechanism; and respective blade members affixed to the blade-support plates, each of the blade members comprising a base connected to the respective plate and a blade extending outwardly from the base away from the hub, each of the plates having a first formation and each of the bases having a second formation mating with the respective first formation, one of the mating first and second formations comprising at least two claws extending inwardly relative to the respective radial axis and angularly spaced therearound, and the other of the mating first and second formations being provided with at least one outwardly open groove adapted to receive the claws, clearances enabling the claws to be received in the groove, and, between the clearances, projections extending outwardly relative to the respective radial axis and engageable under the claws.

The mating formations can have two diametrically opposite claws and projections. In the preferred embodiment, the claws are on the mounting plate as has been noted and the groove and projections are on the base or foot of the blade.

In more general terms, a propeller, especially for a sport boat and either a variable-pitch propeller or a fixed-pitch propeller, can comprise:

a hub;

a plurality of blade supports angularly spaced apart on the hub; and respective blade members affixed to the blade-support plates, each of the blade members comprising a base connected to the respective blade support and a blade extending outwardly from the base away from the hub, each of the blade supports having a first formation and each of the bases having a second formation mating with the respective first formation, one of the mating first and second formations comprising at least two claws extending inwardly and angularly spaced therearound, and the other of the mating first and second formations being provided with at least one outwardly open groove adapted to receive the claws, clearances enabling the claws to be received in the groove, and, between the clearances, projections extending outwardly and engageable under the claws.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
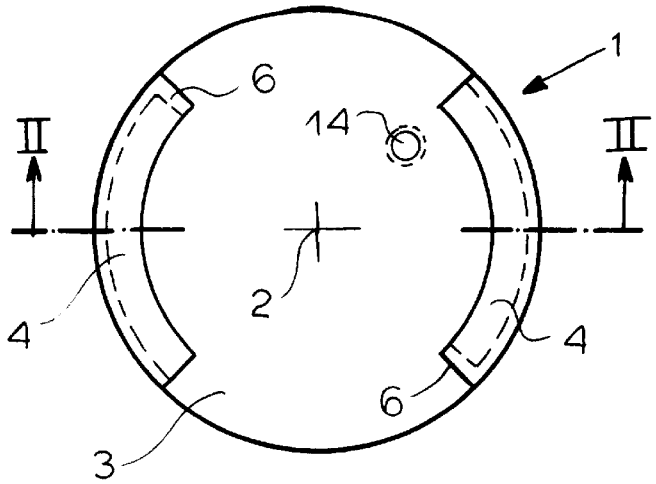
FIG. 1 is a plan view of the upper side of a mounting plate of a variable-pitch propeller for a sport boat according to the invention.
Figure 2:
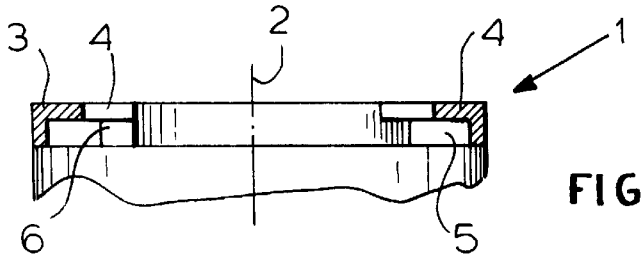
FIG. 2 is a section taken along the line II—II of FIG. 1.

The blade support plate 1 shown in FIGS. 1 and 2, is rotatably mounted on the usual propeller hub and can be angularly displaced about a radial axis 2 of a variable-pitch propeller. The hub usually has at least two such plates and possibly three (see FIGS. 5 and 6) or more, with radial axes thereof being angularly equispaced about the hub axis.

Figure 5:
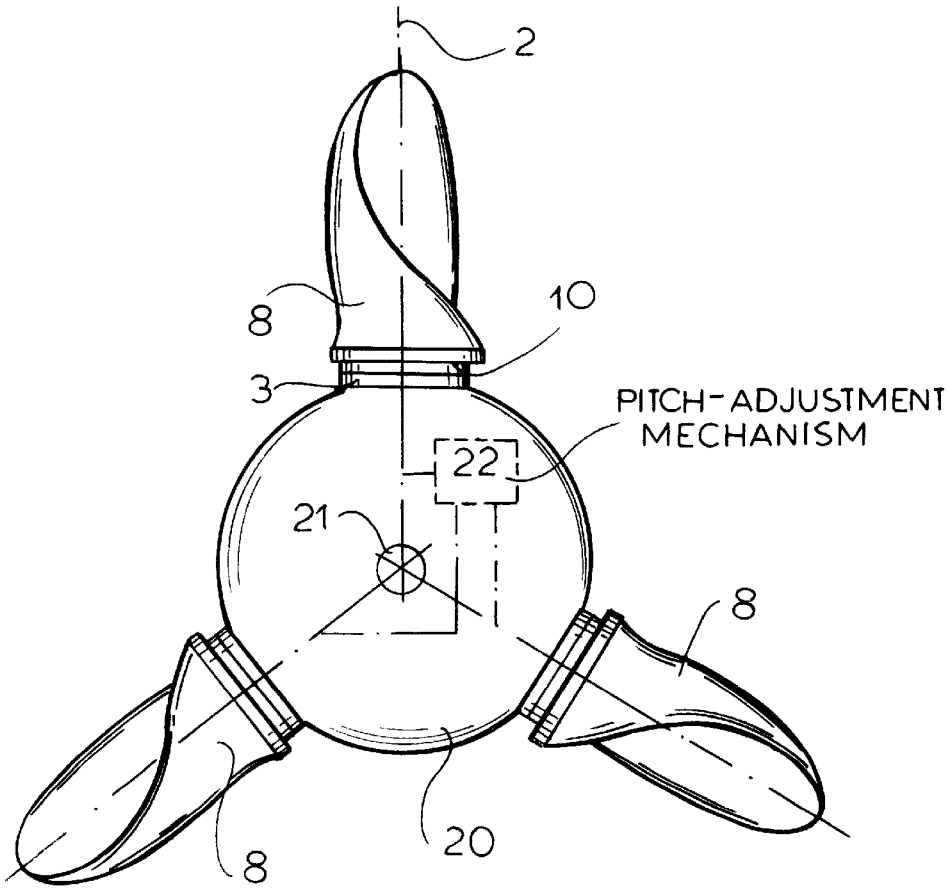
FIG. 5 is an end view of the variable pitch propeller.
Figure 6:
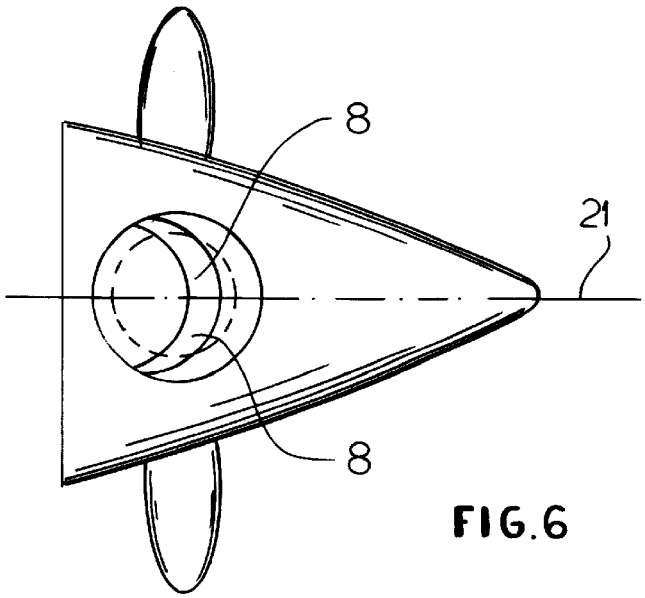
FIG. 6 is a side elevational view thereof.

In FIGS. 5 and 6, the hub has been represented at 20, the hub axis at 21 and the pitch-adjustment mechanism has been shown at 22 within the hub for angularly displacing each of the blades 8 about the respective radial axis 2 to vary the pitch of the propeller.

The upper side 3 of each of the blades 1 is planar and provided with two diametrically-opposite claws 4 projecting radially inwardly and extending along the circumference of the respective plate. The reference to "radial" is here intended to indicate a relationship to the radial adjustment axis 2. Between the claws 4 there remain gaps in the circumferential direction and between each claw 4 and the planar upper side of the plate, there is left a gap 5. In the embodiment shown, each of the claws 4 is provided at one end with an abutment or stop 6.

Figure 3:
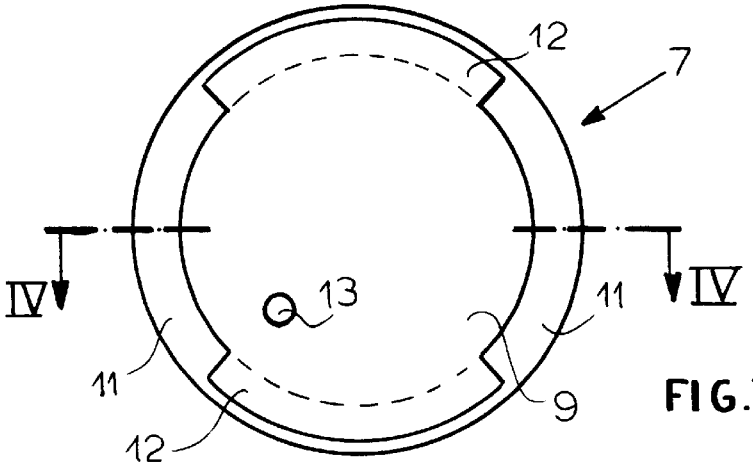
FIG. 3 is a bottom plan view of the underside of the base of a blade.
Figure 4:
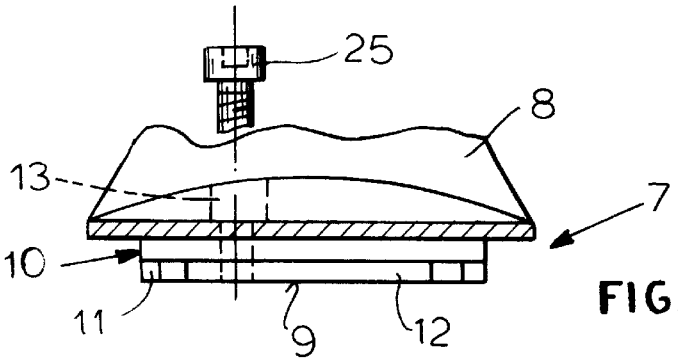
FIG. 4 is a cross sectional view taken along the line IV—IV of FIG. 3.

As can be seen from FIGS. 3 and 4, each of the blades 8 has a blade foot or base 7 having a planar underside 9 and a circumferential groove extending over the entire periphery. The circumferential groove 10 has two radially-opposite cutouts 11 between which the radial projections 12 are disposed. The radius of these projections is somewhat smaller than the radius of the base 7.

In the embodiment illustrated and in the preferred or best mode embodiment, the projections 12 and the cutouts 11, as well as the claws 4, have angular extents of about 90°. The width of the gap 5 between the claws and the upper side 3 of the respective plate 1, corresponds to the thickness of the projection 12.

To mount a propeller blade 8 on the hub, the base 7 thereof is juxtaposed with its underside 9 with the upper side 3 of a respective plate that the claws 4 engage in the cutouts 11 of the base and thus so that the claws are circumferentially aligned with and are in the plane of the circumferential groove. The propeller blade 8 and 6 is rotated about its radial axis 2 so that the claws 4 are engaged in the groove 10 and the projections 12 underlie the claws 4. The blade 8 is so rotated until one or both of its projections 12 come to abut a stop 6 both of or the stops 6. In this position, the blade can be fixed by a screw 25, here an Allen-head screw, which passes through a stepped bore 13 of the base 7 and engages in a threaded bore 14 of the plate 1 aligned therewith. Dismounting of the propeller blade can be effected by the reverse sequence.

Figure 7:
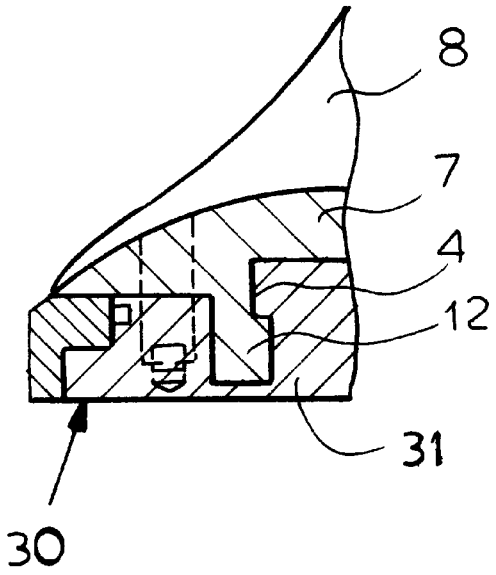
FIG. 7 is a cross sectional view showing another mounting arrangement for a fixed-blade propeller.
Figure 8:
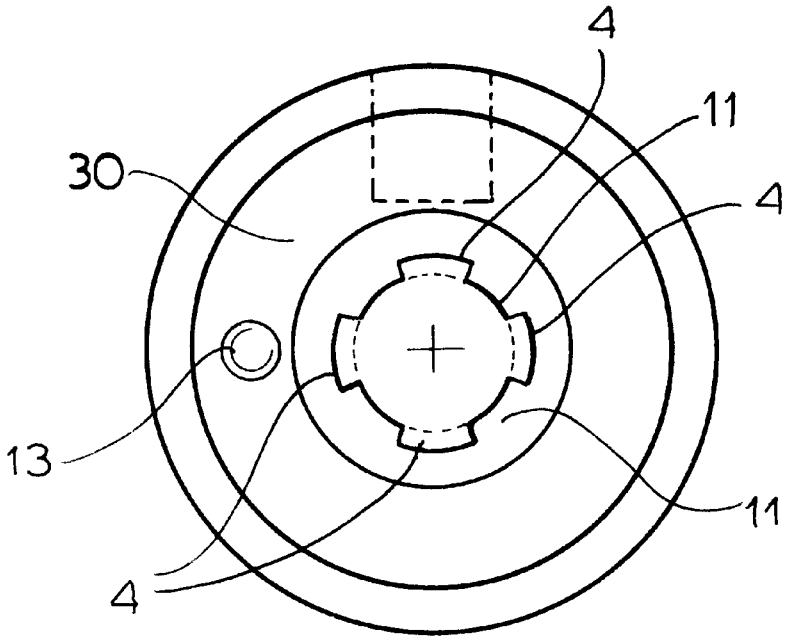
FIG. 8 is a bottom plan view of the underside of the base of the blade of FIG. 7.

FIGS. 7 and 8 show an assembly serving as a fixed-pitch propeller and in which the connection between the blade base 7 and a blade support 30 of a propeller without the capacity for pitch adjustment, utilizes a blade support which is rigid with the hub. The blade support 30 has a central pin 31 with four radially-outwardly projecting claws 4, located substantially with a 90° offset from one another and between which lie free spaces 11. Correspondingly, the base 7 of the blade 8 has four inward projections which, upon insertion into the free spaces 11 and rotation of the blade foot through 90°, come to engage below the projections 4 to provide the bayonet connection between the two parts. Once the bayonet connection is made, a bolt or pin can be inserted through the aligned bores 13 which are offset from the axis as has previously been described to prevent separation of the bayonet connection until the screw has been removed (see the screw 25 of FIG. 4).

I claim:

1. A propeller, especially for a sport boat, comprising:

a hub;

a plurality of blade-support plates angularly spaced apart on said hub; and respective blade members affixed to said blade-support plates, each of said blade members comprising a base connected to the respective blade-support plates and a blade extending outwardly from said base away from said hub, each of said blade-support plates having a first formation and each of said bases having a second formation mating with the respective first formation, one of the mating first and second formations comprising at least two claws extending inwardly and angularly spaced therearound, and the other of the mating first and second formations being provided with at least one groove adapted to receive said claws, clearances enabling said claws to be received in said groove, and, between said clearances, projections extending outwardly and engageable under said claws, mating formations respectively having two diametrically opposite claws and projections said one of said mating formations has a planar surface, said claws overhanging the planar surface, said other of said mating formations having a planar surface juxtaposed with the respective plate, said planar surface of said one of said projections has a spacing from said claws corresponding to a thickness of said projections, at least one of the claws of the mating formations having a stop engageable by a respective projection upon assembling a respective blade member on a respective plate.

2. The propeller defined in claim 1 wherein said mating formations have four claws and projections angularly offset by about 90°.

3. The propeller defined in claim 1 wherein said claws have substantially the same length circumferentially as said projections.

4. The propeller defined in claim 1, further comprising a securing screw between each base and the respective plate.

5. A variable-pitch boat propeller, especially for a sport boat, comprising:

a hub provided with a pitch-adjustment mechanism;

a plurality of blade-support plates angularly spaced apart on said hub and rotatable about respective radial axes by said mechanism; and respective blade members affixed to said blade-support plates, each of said blade members comprising a base connected to the respective plate and a blade extending outwardly from said base away from said hub, each of said plates having a first formation and each of said bases having a second formation mating with the respective first formation, said first formations each comprising at least two claws extending inwardly relative to the respective radial axis and angularly spaced therearound, and the respective second formation being provided with at least one groove adapted to receive said claws, clearances enabling said claws to be received in said groove, and, between said clearances, projections extending outwardly relative to the respective radial axis and engageable under said claws.

6. The variable-pitch propeller defined in claim 5 wherein each of said first formations has a planar surface, said claws overhanging the planar surface with a spacing therefrom, each of said second formations having a planar surface juxtaposed with the respective plate.

7. The variable-pitch propeller defined in claim 6 wherein said spacing corresponds to a thickness of said projections.

8. The variable-pitch propeller defined in claim 7 wherein said claws have substantially the same length circumferentially as said projections.

9. The variable-pitch propeller defined in claim 5 wherein at least one of the claws of the mating formations has a stop engageable by a respective projection upon assembling a respective blade member on a respective plate.

10. The variable-pitch propeller defined in claim 5 further comprising a securing screw between each base and the respective plate.

* * * * *